United States Patent [19]

Kawaguchi

[11] Patent Number: 4,459,563

[45] Date of Patent: Jul. 10, 1984

[54] MAGNETRON UNIT WITH CHOKE STRUCTURE FOR REDUCING HIGHER HARMONICS IN MICROWAVE OUTPUT

[75] Inventor: Toshio Kawaguchi, Yokohama, Japan

[73] Assignee: Tokyo Shibaura Denki Kabushiki Kaisha, Kawasaki, Japan

[21] Appl. No.: 257,615

[22] Filed: Apr. 27, 1981

[30] Foreign Application Priority Data

Apr. 30, 1980 [JP] Japan ..... 55-59646[U]

[51] Int. Cl.[3] ..... H01J 23/32

[52] U.S. Cl. ..... 331/91; 315/39.53

[58] Field of Search ..... 331/86, 88, 90, 91; 315/39.51, 39.53, 39.77, 39.75; 219/10.55 D, 10.55 R

[56] References Cited

U.S. PATENT DOCUMENTS 3,849,737 11/1974 Oguro ..... 315/39.53

4,129,834 12/1978 Kerstens ..... 331/91

FOREIGN PATENT DOCUMENTS 49-115465 11/1974 Japan .

*Primary Examiner*—Siegfried H. Grimm

*Attorney, Agent, or Firm*—Cushman, Darby & Cushman

[57] ABSTRACT

A magnetron of simplified mechanical construction and including choke structures for harmonic suppression. The structure includes an anode cylinder having a plurality of vanes therein and upper and lower open ends; a cathode within said anode cylinder; a cathode stem air-tightly coupled with the second open end of the anode cylinder for supporting the cathode; and an output section. The output section includes an insulated cylinder having a first end and air-tightly coupled with the first open end of the anode cylinder and a second open end; an electrically conductive annular member coaxial with the insulated cylinder; an electrically conductive metal cap coaxial with the annular member; and an output conductor for conducting microwave energy from the anode cylinder to the cap, the cap and output conductor defining a first choke structure for suppressing second harmonic energy and the annular member defining a second choke structure for suppressing a fourth harmonic component of microwave energy.

2 Claims, 3 Drawing Figures

MAGNETRON UNIT WITH CHOKE STRUCTURE FOR REDUCING HIGHER HARMONICS IN MICROWAVE OUTPUT

BACKGROUND OF THE INVENTION

The present invention relates to a magnetron unit with choke structures for reducing higher harmonics in microwave output.

It is well known that the magnetron unit oscillates at higher harmonic waves as well as at its a fundamental microwave frequency. When higher harmonic waves leak out of a microwave cooking oven into which the magnetron unit of such type is incorporated, there is fear that leaked harmonic energy may provide a health risk to users. In addition, leaked harmonic radiation may also interfere with telecommunication frequency channels to disturb communication.

For the purpose of preventing higher harmonic waves from being radiated from the output antenna section of magnetron unit, the conventional magnetron unit is provided with choke structures to suppress higher harmonic waves. U.S. Pat. No. 3,849,737, for example, discloses a magnetron unit provided with two choke structures comprising a metal evacuating tube of predetermined depth $L_1$ and a metal cylinder of predetermined depth $L_2$. However, one of the choke structures of this magnetron unit in which the metal cylinder is attached to an intermediate portion of an output conductor has a problem that it is mechanically unstable. In addition, there is a fear in it that high frequency discharge is caused between the metal cylinder and other parts of magnetron unit.

SUMMARY OF THE INVENTION

The object of the present invention is to provide choke structures that are mechanically stable, simple in construction and capable of reducing higher harmonics in microwave output.

According to the present invention there is provided a magnetron unit comprising an anode cylinder provided with a plurality of vanes extending from the inner surface of anode cylinder to form reasonance cavities; a cathode disposed coaxially with the anode cylinder; a cathode stem for supporting the cathode and being air-tightly coupled with one opening end of anode cylinder; and an output section; said output section including an insulative cylinder one opening end of which is air-tightly coupled with the other opening end of anode cylinder, an output conductor for leading microwave generated in the anode cylinder and extending through openings of anode and insulative cylinders, one end of said output conductor being connected to the reasonance cavity, a first choke structure for suppressing a predetermined harmonic wave component contained in microwaves and being connected to the other end of output conductor, and a second choke structure for suppressing another predetermined harmonic wave component contained in microwaves and being formed around the first choke structure and connected direct to the first choke structure, the other opening of insulative cylinder being air-tightly sealed with first and second choke structures to form an vacuum envelope.

DETAILED DESCRIPTION OF THE EMBODIMENTS

Figure 1:
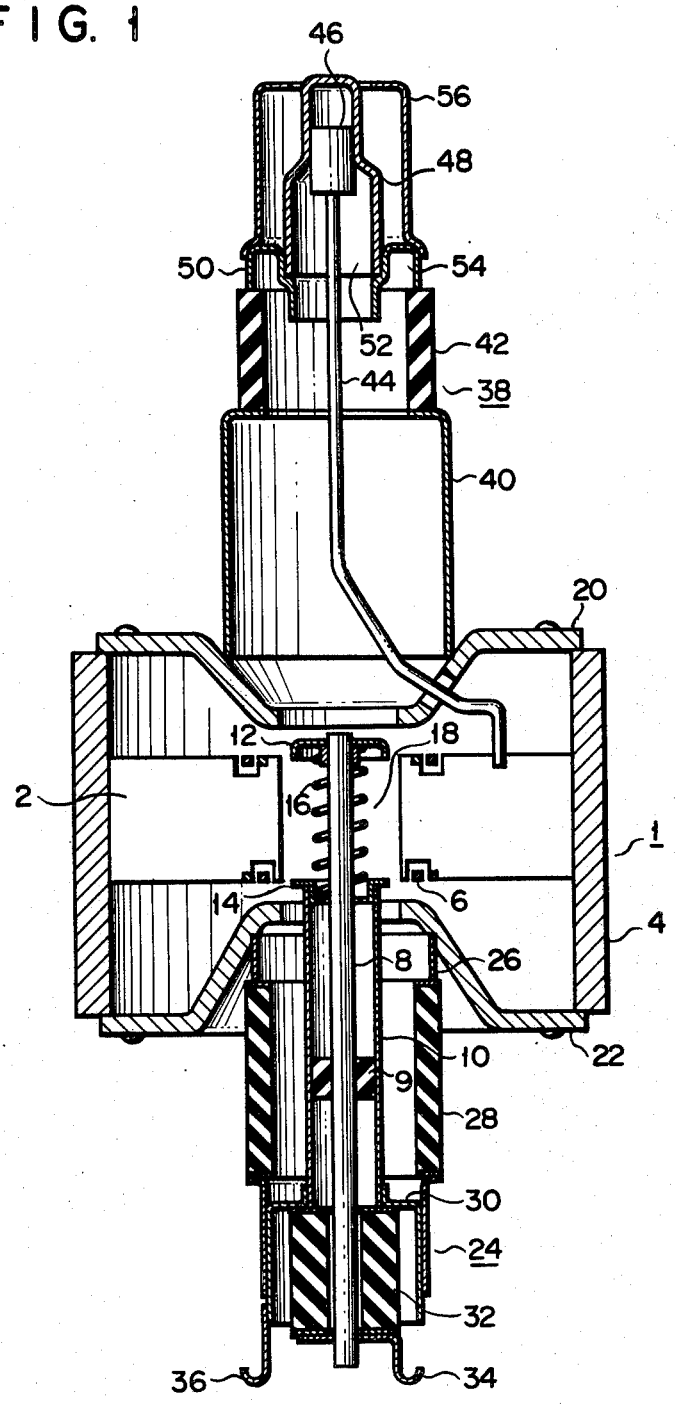
FIG. 1 is a longitudinally-sectioned view showing an example of magnetron unit according to the present invention.

FIG. 1 shows an example of magnetron unit according to the present invention. A magnetron body 1 of magnetron unit includes an anode cylinder 4 inside which a plurality of vanes 2 for defining reasonance cavities are fixedly supported in radial arrangement. Every two of vanes 2 with one vane interposed therebetween is connected by means of straps 6 and a cathode supporting rod 8 extends into the anode cylinder 4 along the central axis of anode cylinder 4 through a cathode supporting cylinder 10. End hats 12 and 14 are fixed onto one end of cathode supporting rod 8 and cylinder 10, respectively. A spiral cathode filament 16 has its ends supported by end hats 12 and 14 and is so disposed as to surround the cathode supporting rod 8, said filament 16 being carbonized and made of thorium tungsten. A pair of pole pieces 20 and 22 each having a center portion projected into the anode cylinder 4 are air-tightly fixed to both opening ends of anode cylinder 4, respectively, and serve to produce magnetic field in an interaction space 18 defined between cathode filament 16 and free ends of vanes 2.

The cathode supporting cylinder 10 extending outside the magnetron body 1 through the opening of one of the pole piece 22 is inserted into a metal cylinder 26 air-tightly fixed to the pole piece 22 and further into an alumina-ceramic cylinder 28 fixed to the metal cylinder 26 in a cathode stem 24. The opening of alumina-ceramic cylinder 28 is air-tightly sealed by a cover 30 made of Kovar and the opening of cathode supporting cylinder 10 is sealed by a block 32 made of alumina-ceramics. The cathode supporting rod 8 is supported by an alumina-ceramic ring 9 in the cathode supporting cylinder 10 with a certain space separated from the inner surface of the cathode supporting cylinder. The cathode supporting rod 8 extends through the block 32 to be connected to a terminal 34 and the cover 30 is connected to a terminal 36.

A microwave output section 38 is arranged on the other pole piece 20. A metal sealing cylinder 40 is air-tightly fixed to the pole piece 20 and a insulative sealing cylinder 42 made of a ceramic is air-tightly fixed to the sealing cylinder 40. An antenna lead 44 is connected at the one end thereof to one of vanes 2 in the magnetron body 1 to conduct microwave generated in the reasonance cavities, thereby the antenna lead 44 being electrically connected to the reasonance cavities. The antenna lead 44 extends outside the opening of sealing cylinder 42 through the through-hole of pole piece 20, metal sealing cylinder 40 and insulative sealing cylinder 42. As shown in detail in FIG. 2, the other end of antenna lead 44 is electrically and mechanically connected to a metal cap 48 through a metal connecting block 46. The metal cap 48 includes a cylindrical portion 48-1 having a smaller inner diameter which is substantially equal to the outer diameter of block 46 and a cylindrical portion 48-2 having a larger inner diameter than that of portion 48-1, and both cylindrical portions 48-1 and 48-2 are formed integral with each other having a stepped portion 48-3 interposed there-between. The metal connecting block 46 is fixed in the cylindrical portion 48-1 of the metal cap. The opening end of cap 48 is inserted into an opening defined by a first inner section 50-2 of an annular cover member 50 and air-tightly fixed to the first inner section 50-2 thereof. An opening end of an outer cylindrical section 50-1 of the annular cover member 50 is sealed to the insulative sealing cylinder 42. The first inner section 50-2 has a step portion 50-3 with which the opening end of cap 48 is contacted, and a second inner cylindrical section 50-5 projects from the step portion 50-3 to the space defined by the insulative sealing cylinder 42 coaxially with the first inner cylindrical section 50-2. The inner diameter of second inner section 50-5 is equal to that of cap 48. Therefore, the antenna lead 44 is combined with the cylindrical portion 48-2 of the cap 48 and the second inner section 50-5 of the annular cover member 50 which are electrically connected to the antena lead to form a first choke cylinder member having a depth $L_1$, which is set to about $\lambda g_1/4$. The choke cylinder member serves to suppress a second harmonic wave. $\lambda g_1$ represents the electric wave length of second harmonic wave. A second choke cylinder member is also formed by the first and second inner sections 50-2 and 50-5 and the outer section 50-1 around the first cylinder member. The depth $L_2$ of second choke cylinder member is set to about $\lambda g_2/4$. Therefore, a second choke structure 54 which serves to suppress a fourth harmonic wave is formed by the second cylinder member. $\lambda g_2$ represents the electric wave length of fourth harmonic wave.

In this case, the depth $L_3$ of the outer section 50-1 is such that it is equal to nearly one half of the depth $L_2$ defined by the first and second sections. As mentioned, the first choke structure 52 comprises a part of the antenna lead 44 and first cylinder member formed of a cap 48 and second inner section 50-5 of the annular cover member 50 and coaxially provided on the portion of the antenna lead 44. Although the second choke structure 54 may be constituted by an annular cover member 50, the first choke structure 52 may be constituted by the cap 48 and the second choke structure 54 be constituted by the annular cover member 50 and a part of the cap 48 which is projected into the insulative sealing cylinder 42. In either case, the outer section 50-1 of the annular cover member 50 is air-tightly sealed to the insulative sealing cylinder 42 and, by so doing, the cap 48 and annular cover member 50 constitute a part of the envelope.

The cap 48 is covered by a metal cap 56 for radiating a fundamental wave which is fixed to the first section 50-1 of annular cover member 50. The space formed in cathode stem 24, magnetron body 1 and output section is held vacuum.

In the case of magnetron unit thus formed, a permanent magnet (not shown) supplies magnetic flux to pole pieces 20 and 22 and magnetic field is produced in the interaction space 18. Heating current is supplied via terminals 34 and 36 to the cathode filament 16 and this cathode filament 16 is heated. When high voltage is applied between cathode filament 16 and vanes 2 to produce electric field in the interaction space 18, the magnetron unit is oscillated to generate microwave, which is lead out through the antenna lead 44. The microwave lead out contains second, third and fourth harmonic waves as well as fundamental wave of 2450 MHz, but the second and higher harmonic waves, for example, fourth harmonic wave are suppressed or reduced by choke structures 52 and 54. Therefore, the microwave radiated from the output section 38 contains almost no intense harmonic wave, and fundamental wave only is radiated.

Figure 2:
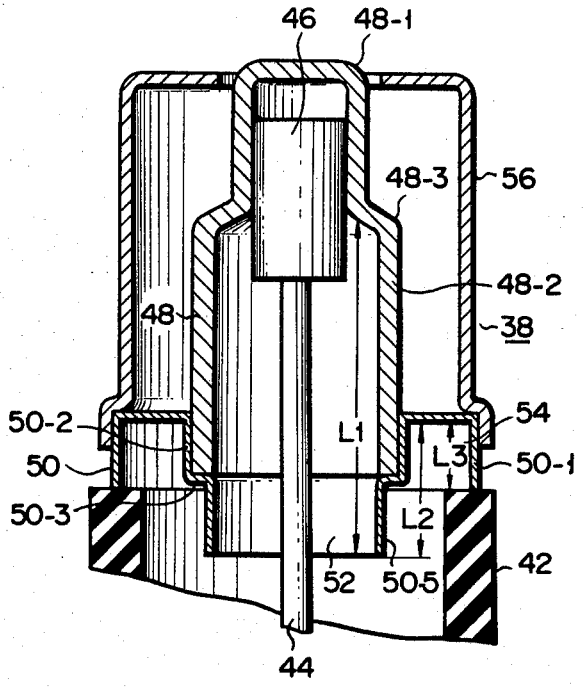
FIG. 2 is a longitudinally-sectioned view showing choke structures of FIG. 1 in an enlarged scale.

Choke structures 52 and 54 shown in FIGS. 1 and 2 are simple and have large mechanical strength. In addition, they can be formed by the cover member 50 to thereby reduce the cost thereof and can suppress harmonic wave more negligible as shown in Table I as compared with those in the conventional magnetron unit.

TABLE I

| | | $L_1$ (mm) | $L_2$ (mm) | Radiation Level (μV) Minimum to Maximum Level | Average Level | Ratio |
|---|---|---|---|---|---|---|
| Second Harmonic Wave | I | 0 | 0 | 510–1050 | 845 | |
| | II | 13.0 | 0 | 52–180 | 95 | $\frac{1}{8.9}$ |
| | V | 13.0 | 7.0 | 65–190 | 105 | $\frac{1}{8}$ |
| Third Harmonic Wave | II | 13.0 | 0 | 125–200 | 150 | |
| | III | 13.0 | 5.0 | 72–160 | 105 | $\frac{1}{1.4}$ |
| | V | 13.0 | 7.0 | 70–150 | 105 | $\frac{1}{1.4}$ |
| Fourth Harmonic Wave | II | 13.0 | 0 | 170–400 | 235 | |
| | III | 13.0 | 5.0 | 18–48 | 29 | $\frac{1}{8.1}$ |
| | IV | 13.0 | 6.0 | 20–54 | 36 | $\frac{1}{6.5}$ |
| | V | 13.0 | 7.0 | 16–52 | 27 | $\frac{1}{8.7}$ |
| | VI | 13.0 | 8.0 | 21–48 | 32 | $\frac{1}{7.3}$ |

Measured data obtained from conventional magnetron units are shown at I and II in Table I in which measured data shown at I are of magnetron unit having no choke structure and measured data shown at II are of magnetron unit having only the first choke structure 52 whose depth $L_1$ is 13.00 mm. Measured data shown at III–VI are of magnetron unit of the present invention in which depths $L_1$ and $L_2$ of first and second choke structures 52 and 54 are different from one another. Any of magnetron units employed to obtain measured data shown at I–VI generates fundamental microwave of 2450 MHz and is intended for use to the electric oven whose output power is about 800 W. Data of each group were obtained by measuring five magnetron units. "Minimum" and "maximum" levels of radiation level represent those of five magnetron units and the "average" level is that of all five magnetron units. "Ratio" represents the one between the average level of radiation levels obtained from magnetron units of group I or II and the average level of radiation levels obtained from magnetron units of group III, IV or VI. Ratios relative to the average level obtained from magnetron units of group I are shown in the column of second harmonic wave component, and ratios relative to the average level obtained from magnetron units of group II are shown in the column of third and fourth harmonic wave components. Measurement was carried out as follows: An electric oven in which the magnetron unit to be measured was housed was arranged in a wave-shielded room. A tray containing water therein was inserted into the electric oven and an opening having a diameter of 10 cm was formed in one side wall of electric oven so as to allow microwave to leak through the opening. A horn antenna was arranged at a position separated 3 m from the opening of electric oven and a device for measuring the level of every frequency was connected to the horn antenna to detect the level of each frequency in leaking microwave.

As apparent from the column of second harmonic wave component in Table I, it can not be said that second harmonic wave component is decreased more largely when the second choke structure 54 is further provided than when only the first choke structure 52 is provided. As apparent from the column of third harmonic wave component, third harmonic wave component is decreased by a choke structure, but its level can not be further lowered by two choke structures. However, as apparent from the column of fourth harmonic wave component, fourth harmonic wave component is sufficiently decreased by forming the second choke structure 54.

Data in Table I show that second and fourth harmonic wave components can be suppressed enough and third harmonic wave component can also be reduced smaller to some extent by first and second choke structures 52 and 54, and that the function of first choke structure 52 to suppress harmonic wave component is neither effected nor lowered even by forming the second choke structure 54 around the first choke structure 52. It is because the opening end of second inner section 50-5 of annular cover member 50 which forms the first choke structure 52 is positioned nearer to the anode cylinder 4 than the fixed end of first section 50-1 thereof. That is, the end portion of the first choke structure is positioned nearer to the anode than the outer end portion of the second choke structure. The second choke structure 54 may be set to have depths $L_2$ and $L_3$ for suppressing the third harmonic waves or higher harmonic wave having frequencies higher than that of fourth harmonic waves.

Figure 3:
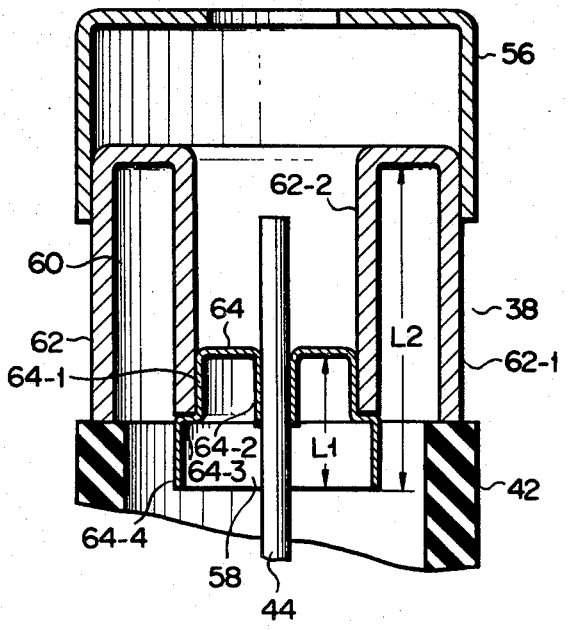
FIG. 3 is a longitudinally-sectioned view showing choke structures formed in a modification of magnetron unit according to the present invention.

FIG. 3 shows another example of choke structures according to the present invention. Same numerals as those in FIG. 2 represent same parts and description of these parts is omitted. In the case of this example, a first choke structure 58 is formed inside to suppress fourth harmonic wave and a second choke structure 60 is formed outside the first choke structure 58 to suppress second harmonic wave. Both of choke structure 58 and 60 are formed by annular cover members 62 and 64. Namely, an outer section 62-1 of outer annular cover member 62 is air-tightly fixed to the sealing cylinder 42, and a first outer section 64-1 of inner annular cover member 64 is inserted into an opening of inner section 62-2 of outer annular cover member 62 and air-tightly fixed thereto. A step section 64-3 of inner annular cover member 64 is contacted with an inner section 62-2 of outer annular cover member 62 and a cylindrical second outer section 64-4 projects from the step section 64-3. The antenna lead 44 is inserted into an inner section 64-2 of outer annular cover member 62, air-tightly fixed and electrically connected fixed thereto. The second choke structure 60 is formed by the inner section 62-2 of member 62 and the second outer section 64-4 of member 64 and the first choke structure 58 is formed by first and second outer sections 64-1 and 64-4 of member 64. These choke structures 58 and 60 are set to have depths of $L_1$ and $L_2$, respectively.

Unlike the magnetron unit as shown in FIG. 2, the magnetron unit as shown in FIG. 3 is such that the second choke structure 60 for suppressing second harmonics is formed outside the first choke structure for suppressing fourth harmonics. Likewise, it is possible to effectively suppress a plurality of different harmonic waves. Moreover, since the choke structures 58 and 60 are formed using a common section, they are simpler, greater in mechanical strength and lower in manufacturing cost.

Although, in the above-mentioned embodiment, two choke structures are adapted to suppress second and fourth harmonic waves, one of the choke structures may mainly suppress not only the fourth harmonic wave, but also the third harmonic wave, or the other high-order harmonics.

What is claimed is:

1. A magnetron comprising:

an anode cylinder having a plurality of vanes extending radially from an inner surface thereof, said anode cylinder having first and second open ends;

a cathode disposed within said anode cylinder and coaxial therewith;

a cathode stem air-tightly coupled with said second open end of said anode cylinder, for supporting said cathode; and an output section for delivering microwave energy from said magnetron, said output section comprising:

an insulative cylinder having a first open end air-tightly coupled with said first open end of said anode cylinder and a second open end;

an electrically conductive annular member, coaxial with said insulative cylinder and air-tightly fitted to said open end of said insulative cylinder, said annular member having a step portion acting as a seat for a cap, said annular member further including a first width portion above said step portion and a second width portion below said step portion, said first width being larger than said second width;

an electrically conductive metal cap coaxial with said annular member and air-tightly fitted therewith, said cap providing an air tight seal for said annular member, said electrically conductive metal cap being force fitted against a wall of said first width portion when it is seated on said step portion;

an output conductor having a first end coupled to at least one vane for conducting microwave energy from said anode cylinder to said cap, the metal cap and output conductor defining at least a portion of a first choke structure for suppressing a second harmonic component of the microwave energy generated within said anode cylinder, and the annular member defining at least a portion of a second choke structure for suppressing a fourth hormonic component of the microwave energy generated within said anode cylinder.

2. A magnetron according to claim 1 wherein said electrically conductive annular member is fitted to said insulative cylinder such that said second width portion forms a gap between said annular member and said insulative cylinder.

* * * * *